United States Patent [19]

Shimoda et al.

[11] Patent Number: 4,551,805

[45] Date of Patent: Nov. 5, 1985

[54] CONTROL SYSTEM FOR STRIP CONFIGURATION

[75] Inventors: Michio Shimoda; Fumio Watanabe, both of Hyogo, Japan

[73] Assignee: Mitsubishi Denki Kabushiki Kaisha, Japan

[21] Appl. No.: 395,069

[22] PCT Filed: Oct. 15, 1981

[86] PCT No.: PCT/JP81/00285

§ 371 Date: Jun. 21, 1982

§ 102(e) Date: Jun. 21, 1982

[87] PCT Pub. No.: WO82/01485

PCT Pub. Date: May 13, 1982

[30] Foreign Application Priority Data

Oct. 30, 1980 [JP] Japan ..... 55-153165

[51] Int. Cl.[4] ..... G06F 15/46; B21B 37/00

[52] U.S. Cl. ..... 364/469; 72/11; 364/472

[58] Field of Search ..... 364/468, 469, 472, 148, 364/152, 194; 72/6, 7, 8, 9, 10, 11, 16

[56] References Cited

U.S. PATENT DOCUMENTS 4,248,072 2/1981 Hasegawa et al. ..... 364/472 X 4,269,051 5/1981 Clarke et al. ..... 364/472 X 4,380,916 4/1983 Tanaka ..... 364/472 X

FOREIGN PATENT DOCUMENTS 143952 11/1977 Japan .

151066 11/1979 Japan .

84211 6/1980 Japan .

OTHER PUBLICATIONS

Iron and Steel, vol. 51, No. 9, Sep. 1977, S. Wilmotte et al.: New Approach to Computer Setup of the Hot Strip Mill, pp. 70–76, * p. 70, col. 2—p. 71, col. 1.

*Primary Examiner*—Joseph Ruggiero

*Attorney, Agent, or Firm*—Sughrue, Mion, Zinn, Macpeak, and Seas

[57] ABSTRACT

In a configuration control system of product material in a strip rolling, to recognize a configuration pattern of a strip material, to clarify the correspondence between control actuators 10, 11 and 12 and configuration defect pattern and to separate local defects, a configuration pattern detected by a configuration detector is converted by an orthogonal function expansion operation device 3 to a series of orthogonal functions, specifically of polynomials, and operation amounts of the respective control actuators 10, 11 and 12 are controlled by coefficients of the respective functions.

4 Claims, 9 Drawing Figures

CONTROL SYSTEM FOR STRIP CONFIGURATION

TECHNICAL FIELD

This invention relates to a control system for configuration of strip material obtained by a rolling.

BACKGROUND ART

In the conventional strip configuration control, there are many cases where there is no concrete indication of correspondency between configuration signals from a configuration detector and an operational variable of an operational actuator (e.g. bending force, rolling operation etc.) for the configuration control or where the processing of them to obtain the correspondency is insufficient. The detector is usually constructed such that the width of the material is divided into segments and the elongation rate (or stress value) of the material in the transverse direction is detected by the detector for each of the segments. Thus, the detector provides output signals for the respective segments. The number of these output signals from the configuration detector is usually several multiples of tens. However, the number of operation points of the configuration control actuator is considerably less. Therefore, in the conventional control system, output signals corresponding to the opposite ends segments and only a portion of intermediate segments are usually used causing the configuration pattern recognition itself to be doubtful. For these reasons, it is impossible for the control system to obtain exact and proper control amounts.

In another example of the conventional control system, wherein the configuration signal from the configuration detector is considered as a function of width and the function is approximated by a suitable function such as a multi-term quadratic equation, it occurs frequently that the approximated function does not always clearly correspond to the respective actuator· operation amount. Further, since, in the latter case, it is impossible to clearly recognize the local configuration defect, there has thus been obtained no effective control on such local configuration defects.

SUMMARY OF THE INVENTION

This invention intends to obtain the control amounts of approximating the elongation rate signals from the configuration detector obtained for the respective transverse segments of the strip material by a high power polynomial, expanding the high power polynomial to a series of orthogonal functions and utilizing the relation of coefficients of the respective orthogonal functions to operation amounts of the actuator to be used for the control, which exhibits a correspondence sufficient to perform a desired control.

According to this invention, since the recognition of configuration defect pattern is facilitated and the correspondence between the control actuators and the configuration defect pattern becomes clear, the control becomes both simple and effective and the local configuration defects can be clearly separated, resulting in a remarkable increase in the configuration control of strip material.

BRIEF DESCRIPTION OF THE DRAWINGS

FIGS. 6 to 8 show embodiments of the local defects detection system according to the present invention, in which FIG. 6 is a plot of the actually measured data and the orthogonal function expansion valves;

FIG. 7 is a plot of errors between the measured data and the expansion values and FIG. 8 illustrates an example of a local defect calculated according to the present invention.

DETAILED DESCRIPTION OF THE PREFERRED EMBODIMENT

Figure 1:
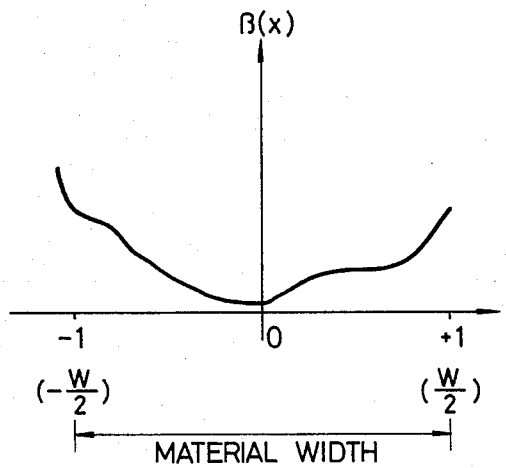
FIG. 1 is an example of the configuration signal (elongation rate), which is normalized with the width of strip.

It is assumed that a plot of detector signals (elongation rate) from the configuration detector, which is normalized with reference to the width of the strip material as shown in FIG. 1 is expressed as a function $\beta(x)$ where $$-1 \leqq x \leqq 1,$$

and where $$x = -1 \text{ and } x = +1 \tag{3.1}$$

represents a left end and right end of the width of the strip material, respectively.

Then the following functions are defined.

$$\left.\begin{aligned} \phi_0(x) &= P_{00} \\ \phi_1(x) &= P_{11}x \\ \phi_2(x) &= P_{22}x^2 + P_{20} \\ \phi_3(x) &= P_{33}x^3 + P_{31}x \\ \phi_4(x) &= P_{44}x^4 + P_{42}x^2 + P_{40} \\ \phi_n(x) &= P_{nn}x^n + \ldots P_{no} \end{aligned}\right\} \tag{3.2}$$

where the respective coefficients $P_{ij}$ are determined according to the following orthogonality relations.

$$\int_{-1}^{1} \phi_l \cdot \phi_m \, dx = 0 \text{ for } l \neq m \tag{3.3}$$

$$= 1 \text{ for } l = m$$

$$(l, m = 0, \ldots, n)$$

Then the following operations are performed on the function $\beta(x)$.

$$C_0 = \int_{-1}^{1} \phi_0(x)\, \beta(x)\, dx \tag{3.5}$$

-continued $$C_1 = \int_{-1}^{1} \phi_1(x)\,\beta(x)\,dx$$

$$C_2 = \int_{-1}^{1} \phi_2(x)\,\beta(x)\,dx$$

$$C_3 = \int_{-1}^{1} \phi_3(x)\,\beta(x)\,dx$$

$$C_4 = \int_{-1}^{1} \phi_4(x)\,\beta(x)\,dx$$

$$C_n = \int_{-1}^{1} \phi_n(x)\,\beta(x)\,dx$$

$$f(x) = C_0\,\phi_0(x) + C_1\,\phi_1(x) + C_2\,\phi_2(x) + C_3\,\phi_3(x) + C_4\,\phi_4(x) + \ldots + C_n\,\phi_n(x) \ldots$$

The function $\beta(x)$ is represented by using the function $f(x)$ obtained by the equation (3.5).

Figure 2:
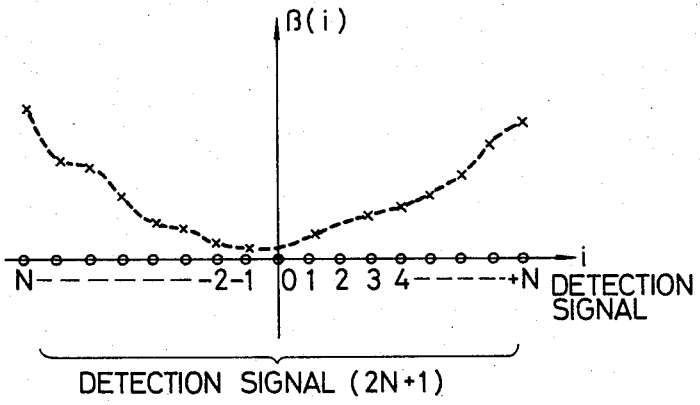
FIG. 2 illustrates the fact that an actual signal from the detector is composed of discrete signals separately obtained along the widthwise direction.

It is usual, in practice, that the configuration detector provides output signals for the respective segmented areas of the strip material in the transverse or widthwise direction. Assuming that the output signals from the configuration detector are provided for equally spaced (2N+1) widthwise segments of the strip material as shown in FIG. 2, the orthogonal functions defined by the equation (3.3) are now defined according to the orthogonality relations $$\sum_{-N}^{N} \phi_l(i)\cdot\phi_m(i) = 0 \text{ for } l \neq m \quad = 1 \text{ for } l = m \tag{3.6}$$

as follows $$\left.\begin{aligned}
\phi_0(i) &= P_{00}\\
\phi_1(i) &= P_{11}\left(\frac{i}{N}\right)\\
\phi_2(i) &= P_{22}\left(\frac{i}{N}\right)^2 + P_{20}\\
\phi_3(i) &= P_{33}\left(\frac{i}{N}\right)^2 + P_{31}\left(\frac{i}{N}\right)\\
\phi_4(i) &= P_{44}\left(\frac{i}{N}\right)^4 + P_{42}\left(\frac{i}{N}\right)^2 + P_{40}\\
\phi_n(i) &= P_{nn}\left(\frac{i}{N}\right)^4 + \ldots
\end{aligned}\right\} \tag{3.7}$$

and the coefficients $C_o, \ldots, C_n$ thereof are, similarly, obtained as follows $$C_0 = \sum_{i=-N}^{N} \beta(i)\cdot\phi_0(i) \tag{3.8}$$

$$C_1 = \sum_{i=-N}^{N} \beta(i)\cdot\phi_1(i)$$

$$C_2 = \sum_{i=-N}^{N} \beta(i)\,\phi_2(i)$$

$$\ldots$$

-continued $$C_n = \sum_{i=-N}^{N} \beta(i)\cdot\phi_n(i)$$

Figure 3:
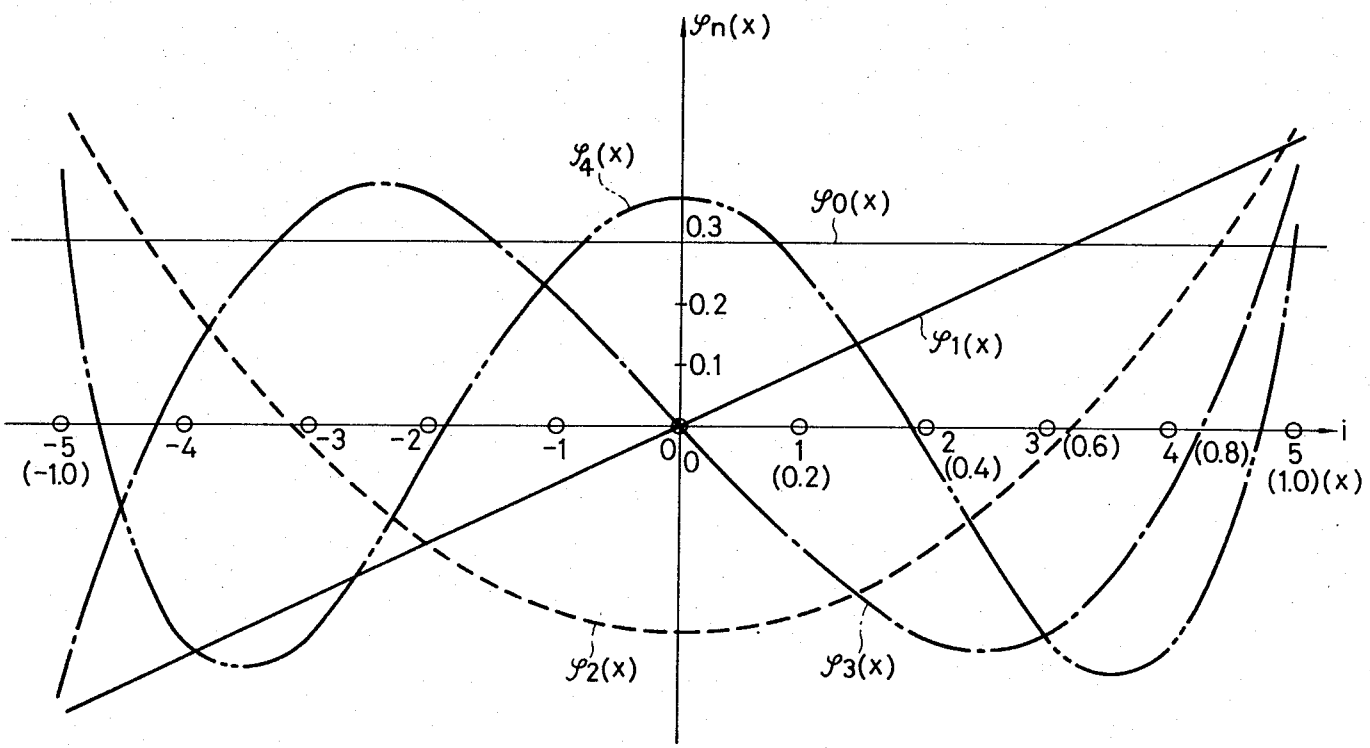
FIG. 3 illustrates the normalized orthogonal biquadratic functions.

FIG. 3 shows the orthogonal functions when n=4 and N=5. Empirically from various measurements, it is reasonable to select n as being in the order of 4 (i.e. a biquadratic polynomial). With such selection of n, the calculation itself is not very sophisticated. Therefore, the biquadratic polynomial will be used hereinafter.

Figure 4:
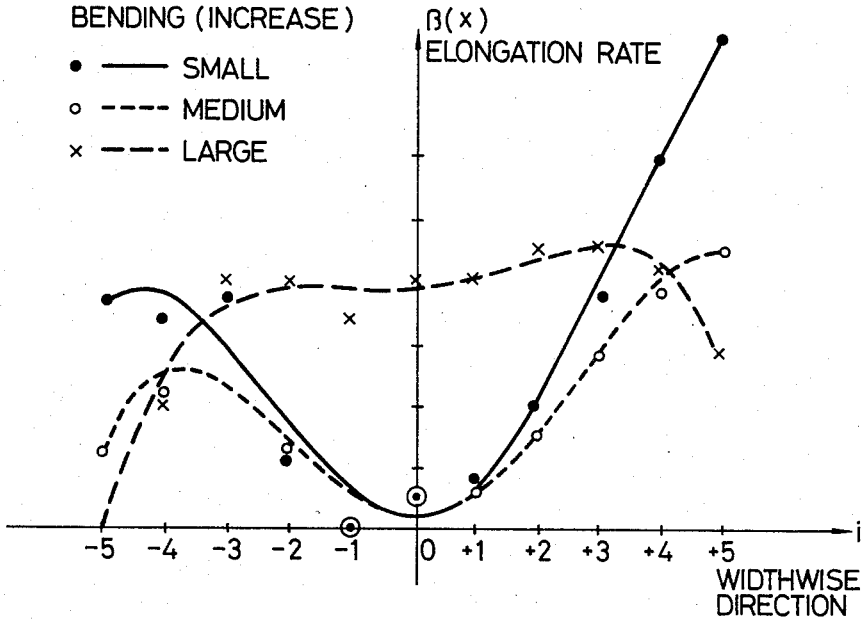
FIG. 4 shows an example of actually measured configuration defects and an orthogonal expansion thereof.
Figure 5:
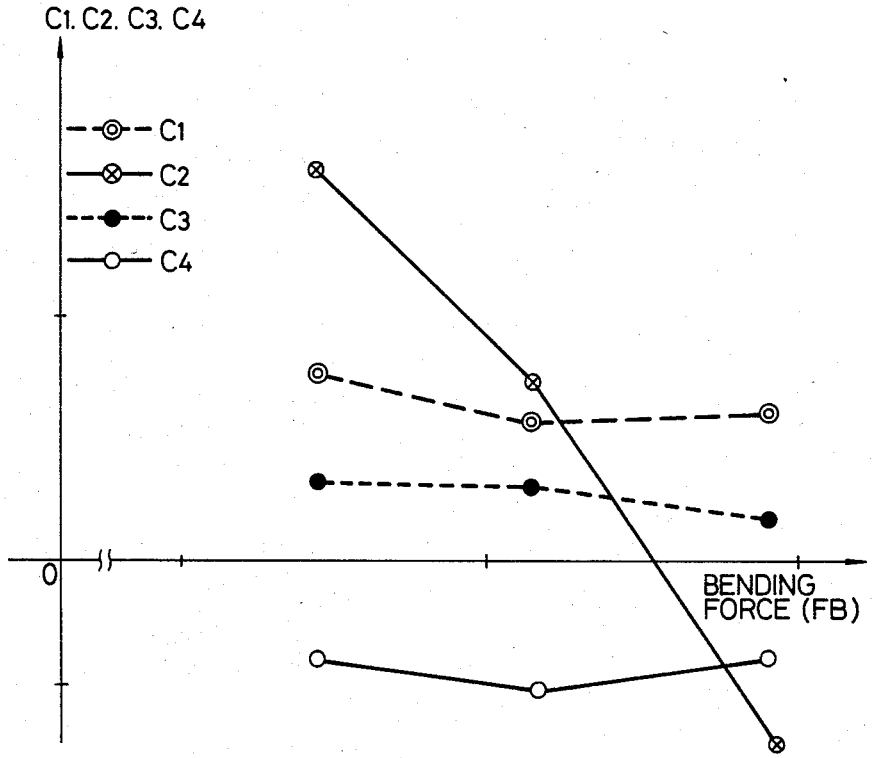
FIG. 5 is a plot of coefficient values $C_1$–$C_4$ of orthogonal functions obtained by expanding the actually measured data in FIG. 4, with a variation of a bending amount.

FIGS. 4 and 5 show examples of the correspondence between the coefficients $C_0, \ldots, C_4$ and the actuator used for the control which is experimentally measured in an actual strip rolling operation. That is, FIG. 4 is a plot of widthwise elongation rate distribution and FIG. 5 is a plot of the coefficient values of the respective orthogonal functions, both plots showing a variation with the bending force of the rolling mill in an actual four-step with variation. In FIG. 4, measured values of the elongation rate at various widthwise segments of the strip and those approximated by expanding them by the present invention according to the orthogonal biquadratic functions are plotted with the bending force as a parameter. FIG. 5 shows plots of coefficient values $C_1 \ldots, C_4$ of the orthogonal functions used in FIG. 4. As is clear from FIG. 5, when the bending force is varied, the coefficient $C_2$ changes.remarkably while other coefficients $C_1$, $C_3$, $C_4$ do not change substantially. Further it was recognized under a constant rolling condition that the relation between the coefficient $C_2$ and the bending force $F_B$ is linear. On the other hand, it has been found that when the rolling operation is performed separately and in opposite directions on the driving side and on the operation side of the rolling will, in order to realize the so-called rolling reduction levelling operation, the coefficient $C_1$ changes remarkably while $C_3$ changes only slightly, $C_2$ and $C_4$ being substantially not changed.

That is, it has been found that the operation amounts of the respective actuators can be easily determined by the coefficients values $C_1$, $C_2$, $C_3$ and $C_4$ of the respective orthogonal functions.

Although a satisfactory effect can be expected by performing the control with using only the orthogonal function coefficients $C_1$–$C_4$, it may be not satisfacory for a local configuration defect. For example, this previously described method is not effective for the local defect (usually referred to as $\pi$ cross wave or dust wave) appearing at the end portions of the strip material or a local defect due to local non-uniformity in material of the strip which affects the final product quality. In order to resolve this problem, the following additional processing is performed.

$$\epsilon(i) = \beta(i) - f(i) \tag{3.9}$$

$(i = -N, \ldots -1, 0, 1 \ldots N)$ $\epsilon(i)$ is the error between the measured value $\beta(i)$ and the function $f(i)$ expanded in orthogonal function.

The part of $\epsilon(i)$, whose absolute value is large, may include some portion which can not be represented by the biquadratic polynomial. Therefore, $\epsilon(i)$ whose absolute value is maximum will be considered. If $[\epsilon(i)]$ is maximum at i=l, it is assumed $$\beta'^{(l)}(i) = \beta(i) \text{ for } i \neq l$$

$$\beta'^{(l)}(i) = \beta(i) + \Delta\beta' l \text{ for } i = l \tag{3.10}$$

A sum of the square of the equation (3.9) is $$\sum^{i} \epsilon^2(i) = \Sigma\, \beta^2(i) + \sum^{i} \{C_0\phi_0(i) + \ldots + C_4\phi_4(i)\}^2 - \sum^{i} 2\, \beta(i)\, \{C_0\phi_0(i) + \ldots + C_4\phi_4(i)\} \tag{3.11}$$

From equation (3.8), this reduces to $$\sum^{i} \epsilon^2(i) = \sum^{i} \beta^2(i) - \{C_0^2 + C_1^2 + \ldots + C_4^2\} \tag{3.12}$$

On the other hand, an error $\epsilon^{(l)}(i)$ after transformed according to the equation (3.10) becomes, $$\begin{aligned} \epsilon'^{(l)}(i) &= \beta'(i) - f(i) \\ &= \beta(i) - f(i) \text{ for } i \neq l \\ &= \beta(i) + \Delta\beta'_l - f(i) \text{ for } i = l \end{aligned} \tag{3.13}$$

Considering the sum of the squares, the following equation is obtained.

$$\sum^{i} \epsilon'^{(l)2}(i) = \sum^{i} \beta^2(i) + 2\,\Delta\beta'_l\,\beta^{(l)} + \Delta\beta'^2_l - [(C_0^2 + C_1^2 + \ldots + C_4^2) + 2\,\Delta\beta'l\,\{C_0\phi_0(l) + C_1\phi_1(l) + \ldots + C_4\phi_4(l) + \Delta\beta'^2_l\,\{\phi_0^2(l) + \ldots + \phi_4^2(l)] \tag{3.14}$$

By further manipulation the following is established $$\sum^{i} \epsilon'^{(l)2}(i) = \sum^{i} \epsilon^2(i) + 2\,\Delta\beta'_l\epsilon(l) + \Delta\beta'^2_l\left\{1 - \sum_{k=1}^{4} \phi_k^2(l)\right\} \tag{3.15}$$

The $\Delta\beta'l$ for which equation (3.15) is minimized can be obtained as follow, $$\Delta\beta'_l = -\frac{\epsilon(l)}{\sum_{K=1}^{4} \phi_k^2(l)} \tag{3.16}$$

Therefore, when i=l, $$\begin{aligned} \epsilon'^{(l)}(i) &= \epsilon(i) - \Delta\beta'_l \sum_{k=1}^{4} \phi_k(l)\,\phi_k(i) \\ &= \epsilon(i) + \frac{\epsilon(l)}{1 - \sum_{k=1}^{4} \phi_k^2(l)} \sum_{k=1}^{4} \phi_k(l)\,\phi_k(i) \end{aligned} \tag{3.17}$$

Similarly, the maximum absolute value of $\epsilon'^{(l)}(i)$ is considered. Assuming that, when i=m, $|\epsilon'^{(l)}(1)|$ becomes a maximum, the following operation is repeated until $$\sum^{i} \epsilon'^2(i)$$

becomes sufficiently small:

$$\left.\begin{aligned} \beta''^{(m)}(i) &= \beta'^{(l)}(i) & i \neq m \\ &= \beta'^{(l)}(i) + \Delta\beta''_m & i = m \end{aligned}\right\} \tag{3.18}$$

Figure 6:
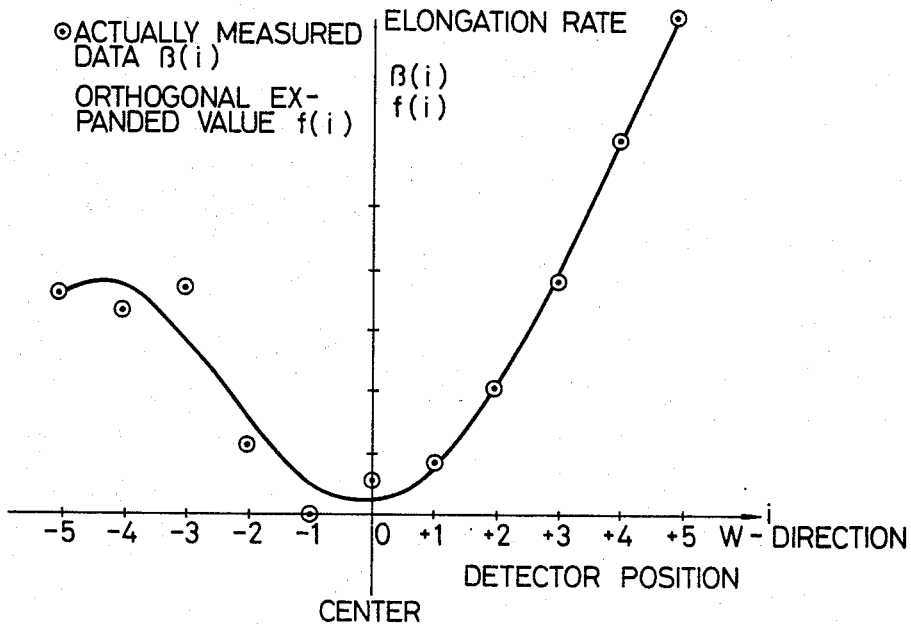
Figure 7:
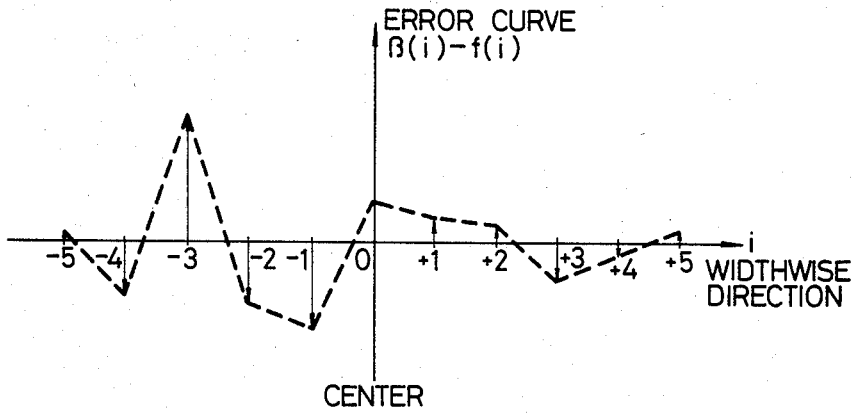
Figure 8:
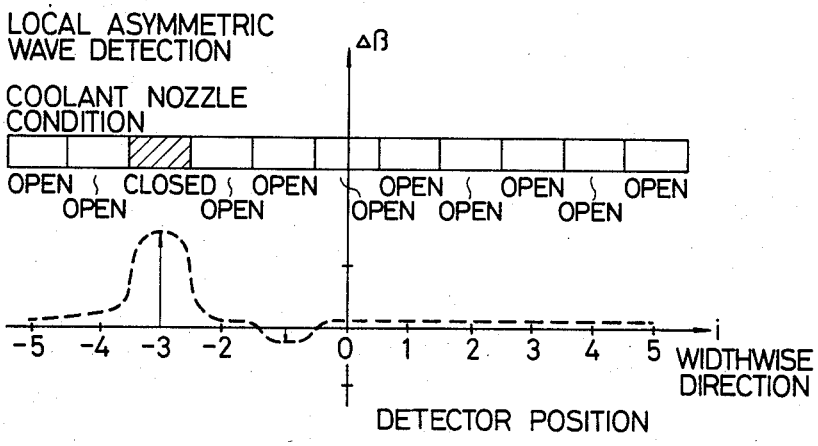

From these operations, it is recognized that there are local defects associated with $-\Delta\beta'_l$, $-\Delta\beta''_m \ldots$ at i=l, m, . . . , respectively and the configurations thereof are recognized as corresponding to the those expansion in biquadratic functions. FIGS. 6 to 8 show examples when the present method is applied practically.

FIG. 6 includes a plot of the measured values of the elongation rate and a curve of the associated biquadratic orthogonal functions as a function of the position of the detector. In this example, one of the coolant nozzle valves for a back-up roll at the position-3 is closed while other coolant nozzle valves are opened. FIG. 7 is a plot of errors with respect to the measured values and FIG. 8 shows $\Delta\beta$ obtained by calculation according to the present invention. As will be clear from FIG. 8, the value of $\Delta\beta$ for the portion at which the associated coolant nozzle valve is closed is very large. That is, by using the present method, it is possible to clearly separate numerically the local configuration defect from others, which was very difficult to quantize previously, and it is possible to control such local a configuration defect by controlling the amount of $\Delta\beta$ at such detector position and the distribution of coolant thereat.

Figure 9:
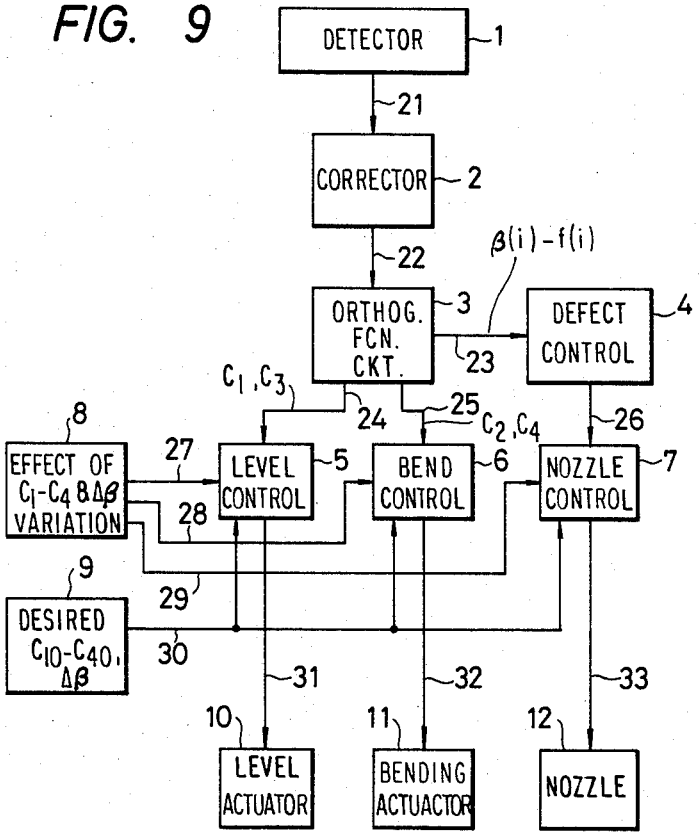
FIG. 9 is a block diagram showing one embodiment of this invention.

FIG. 9 shows an embodiment of the present invention.

The configuration detector (1) provides configuration output signal on a line (21). The output signal is corrected by an enlongation rate operator (2) to an elongation rate signal which appears on a line (22). The latter signal is operated by a orthogonal function expansion and operation device (3) according to the equation (3.8). The symmetric components $C_1$ and $C_3$ of the coefficients $C_1$ to $C_4$ of the respective orthogonal functions are sent along a line 24 to a rolling reduction levelling control and operation device (5) and symmetric components $C_2$ and $C_4$ thereof are sent along a line 25 to a bending control and operation device (16). Further the error between the measured value and the orthogonal function expansion value is inputted along a line 23 to a local defect detection and operation device (4) in which it is operated according to the equation (3.16) and an output of the latter device (4) is sent through a line 26 to a coolant nozzle control and operation device 7 as representing the position and the quantity of the local defect. In the control and operation devices 5, 6 and 7, the configuration coefficients on the lines 24, 25 and 26 are compared with the configuration pattern setting amounts $C_{10}, \ldots C_{40}$ and the value of $\Delta\beta$ provided by a desired configuration pattern setting device 9, respectively. At the same time an influence operation device 8 calculates the effects of the variations of the respective orthogonal coefficients $C_1$–$C_4$ and $\Delta\beta$ on variations of the respective rolling reduction levelling, the bending and the distribution amount of coolant and provides them on lines 27, 28 and 29 connected to the operation devices 5, 6 and 7, respectively. Thus, controlling amounts of the rolling reduction levelling, the bending and the coolant distribution are calculated in the respective operation devices 5, 6 and 7 and the controlling amounts are supplied to a rolling reduction levelling control device 10, a bending control device 11 and a coolant nozzle valve control device 12 respectively, to control the configuration.

Although, in the aforementioned embodiment, the rolling reduction levelling, the bending and the coolant nozzle distribution are indicated as the control actuators, other actuator such as, for example, a widthwise position control of an intermediate roll of the recent multi roll rolling mill, may be considered or it may be possible to suitably combine these actuators to perform the configuration control.

This invention can be applied in the control of the settings for an actuator in a rolling mill.

We claim:

1. A configuration control system for the fabrication of a strip material, comprising:

detecting means for detecting a configuration pattern of said strip material at a plurality of positions on said strip material;

means for converting said detected configuration pattern to coefficients multiplying orthogonal polynomials, said coefficients and polynomials forming series representation of said configuration pattern, said series containing at least four polynomials; and means for controlling the fabrication of said strip material by the values of at least one of said coefficients.

2. A configuration control system as recited in claim 1, further comprising:

means for comparing said detected configuration pattern with a configuration pattern derived from said coefficients and for producing error signals for a plurality of said positions;

means for minimizing the sum of the squares of augmented error signals corresponding to a plurality of said positions, said augmented error signals being equal to said error signals except the one error signal having the largest absolute value, said one error signal being augmented by a value for a local defect that minimizes said sum; and means for controlling the fabrication of said strip material by the value of said local defect.

3. A method for configuration control in the fabrication of a strip material, comprising the steps of:

detecting a configuration pattern of said strip material at a plurality of positions on said strip material;

converting said detected configuration pattern to coefficients multiplying orthogonal polynomials, said coefficients and polynomials forming series representation of said configuration pattern, said series containing at least four polynomials; and controlling the fabrication of said strip material by the values of at least one of said coefficients.

4. A method as recited in claim 3, further comprising the steps of:

comparing said detected configuration pattern with a configuration pattern derived from said coefficients and for producing error signals for a plurality of said positions;

minimizing the sum of the squares of augmented error signals corresponding to a plurality of said positions, said augmented error signals being equal to said error signals except the one error signal having the largest absolute value, said one error signal being augmented by a value for a local defect that minimizes said sum; and controlling the fabrication of said strip material by the value of said local defect.

* * * * *